US006790012B2

(12) United States Patent
Sharp et al.

(10) Patent No.: US 6,790,012 B2
(45) **Date of Patent: *Sep. 14, 2004**

(54) ENCLOSURE FOR AN AIR COMPRESSOR

(75) Inventors: Stephen J. Sharp, Cornelius, NC (US); Michael J Lucas, Mooresville, NC (US); Subodh Kumar, Mooresville, NC (US); Craig Haddock, Mooresville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/045,521

(22) Filed: Oct. 26, 2001

(65) Prior Publication Data

US 2002/0106282 A1 Aug. 8, 2002

Related U.S. Application Data

(63) Continuation-in-part of application No. 09/777,210, filed on Feb. 5, 2001, now Pat. No. 6,447,264.

(51) Int. Cl.[7] ..... F04B 23/14

(52) U.S. Cl. ..... 417/201; 417/313; 417/423.14; 181/198

(58) Field of Search ..... 417/201, 313, 417/312, 243, 423.8, 423.14, 363, 368, 372; 415/119; 181/198, 200, 202, 207, 208, 212, 224, 225, 264

(56) References Cited

U.S. PATENT DOCUMENTS 3,989,415 A * 11/1976 Van-Hee et al. ..... 417/312
4,264,282 A 4/1981 Crago
4,311,439 A * 1/1982 Stofen ..... 417/313
4,359,085 A * 11/1982 Mueller ..... 165/47
4,492,533 A * 1/1985 Tsuge ..... 417/372
4,585,398 A 4/1986 Drake
4,902,226 A 2/1990 Elliott et al.
4,976,098 A 12/1990 Meyer et al.
5,127,808 A * 7/1992 Nichols et al. ..... 417/411
5,151,016 A 9/1992 Her
5,240,648 A 8/1993 Gill et al.
5,507,618 A * 4/1996 Kubo et al. ..... 415/182.1
5,672,052 A * 9/1997 Ishida et al. ..... 417/312
5,997,258 A * 12/1999 Sawyer, III et al. ..... 417/312
6,321,557 B1 * 11/2001 Scrivener et al. ..... 62/296
6,447,264 B1 * 9/2002 Lucas et al. ..... 417/313

FOREIGN PATENT DOCUMENTS

EP 0732511 A1 9/1996
GB 1305655 2/1973
JP 01-313694 12/1989

* cited by examiner

*Primary Examiner*—Justine R. Yu
*Assistant Examiner*—Han L Liu
(74) *Attorney, Agent, or Firm*—Michael Best & Friedrich LLP

(57) ABSTRACT

An air compressor unit having an enclosure that permits adequate cooling air flow, and reduces the amount of noise that emanates from the air compressor unit. The enclosure has a partition that separates the interior of the enclosure into two compartments: a discharge compartment and a component compartment. A discharge aperture is in fluid flow communication with the discharge compartment. A compressor and motor are contained in the component compartment. The component compartment may be separated in a first compartment and a second compartment. Inlets allow cooling air to enter the enclosure, and a discharge aperture permits the cooling air to exit the enclosure. A blower draws cooling air into the enclosure through the inlets. An aftercooler is located between the compressor and the discharge aperture. The enclosure and compartments are configured to reduce the amount of direct "line of sight" noise that emanates from the air compressor unit.

17 Claims, 3 Drawing Sheets

ENCLOSURE FOR AN AIR COMPRESSOR

This application is a continuation-in-part of U.S. patent application Ser. No. 09/777,210 filed Feb. 5, 2001, now U.S. Pat. No. 6,447,264, the entire contents of which are incorporated herein by reference.

FIELD OF THE INVENTION

This invention relates to air compressors, and more particularly to cooling and noise reduction systems for air compressors.

BACKGROUND OF THE INVENTION

Air compressors commonly generate a significant amount of undesirable noise. Because of the undesirable level of noise created by a compressor, it is often necessary to provide a separate room near a work shop or job site to house the compressor. The cost of providing a separate room for the compressor can be substantial. In other arrangements air compressors are provided with enclosures, but to ensure the reliability of an air compressor in all environments, it is also important that an adequate supply of cool ambient air is properly routed through the compressor enclosure and into key areas of the compressor. The operating requirements of the compressor are directly related to how well heat is transferred from the compressor components to the ambient air. The design and layout of the compressor must ensure that a sufficient amount of cool ambient air is available for all of the components of the compressor. However, inlets and outlets that allow ambient air to pass through the compressor housing also allow noise to leave the compressor housing. There is a trade off between providing a sufficient cooling air flow through the compressor enclosure, and allowing compressor noise to exit the compressor enclosure.

SUMMARY OF THE INVENTION

The invention relates to a cooling system and noise reduction system of an air compressor unit that compresses air to pressures above normal atmospheric pressures. The air compressor unit includes an enclosure that houses the compressor components. A partition is provided to at least partially separate the interior of the enclosure into two separate compartments: a discharge compartment, and a component compartment. A compressor is disposed within the component compartment. Air flow is provided into the component compartment, and air then flows into the discharge compartment. The discharge compartment has a discharge aperture that permits air to exit the enclosure. An aftercooler is disposed within the enclosure, and may separate the discharge compartment from the component compartment. The aftercooler may be disposed between and separate the compressor and the discharge aperture.

An additional partition may be provided to further separate the component compartment into two separate compartments: a first compartment and a second compartment. The compressor is disposed within the first compartment, and a motor is disposed within the second compartment. A passage in the partition permits cooling air flow from the first compartment to the second compartment.

The enclosure also has a compressor air flow inlet that is in fluid flow communication with the first compartment, and a motor inlet that is in fluid flow communication with the second compartment. The inlets permit cooling air to enter the first compartment and the second compartment of the enclosure. The partition also has a first passage that permits cooling air to flow from the first compartment to the second compartment, and a second passage that permits cooling air to flow from the second compartment to the discharge compartment. A blower moves cooling air into the inlets, and a shroud covers the blower. A screen permits air to enter the shroud.

The arrangement of the invention provides adequate cooling air flow through the unit while also reducing the amount of noise that emanates from the air compressor unit by limiting the amount of noise exiting the enclosure in a direct "line of sight" path. Sound generally emanates outwardly from a noise source in a relatively straight line, or a "line of sight" path. The sound may reflect off a surface, but reflected noise is reduced in the arrangement of the invention by employing the use of an acoustic foam on surfaces of the enclosure to inhibit the reflection of sound.

By using acoustic foam, and reducing the direct "line of sight" path of the noise, the noise emanating from the unit is reduced. The direct path "line of sight" is broken up by creating multiple compartments and compartments in the enclosure, and having the cooling air and noise flow in a serpentine path through the compartments. The air flow path reduces the amount of direct "line of sight" noise that emanates from the enclosure, and permits adequate cooling air flow.

The discharge aperture is the largest opening in the enclosure, and is the primary location where noise can exit the enclosure. Noise may also exit the enclosure through the inlets and the shroud. The primary noise sources in the unit are the compressor and the motor. The discharge compartment separates the discharge aperture from the noise sources, and inhibits noise from travelling in a direct path from the noise source to the discharge aperture. Noise is prevented from directly reaching the discharge aperture by the partition and baffles. The unit may also contain the primary noise sources in additional separate compartments, which further reduces the amount of noise that emanates from the enclosure.

Figure 1:
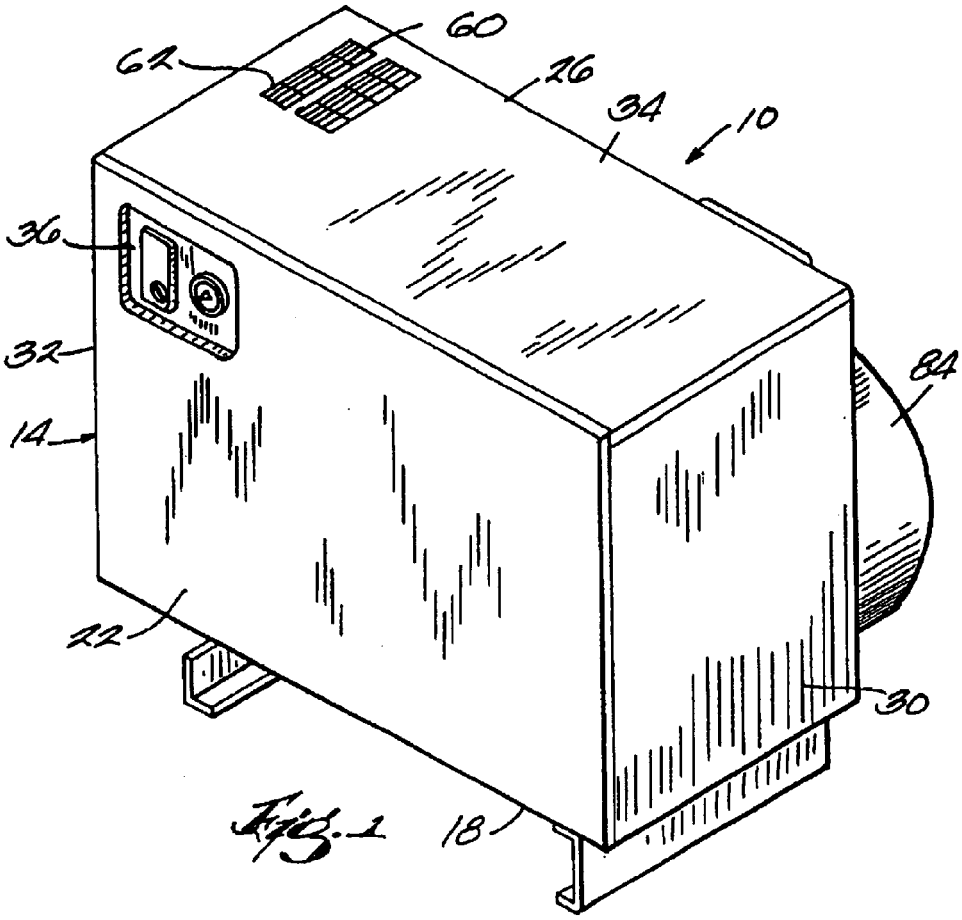
FIG. 1 is a perspective view of an air compressor unit embodying the invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references are made below to directions, such as left, right, up, down, top, bottom, front, rear, back etc., in describing the drawings, they are made relative to the drawings (as normally viewed) for convenience. These directions are not intended to be taken literally or limit the present invention in any form.

DETAILED DESCRIPTION

Figure 2:
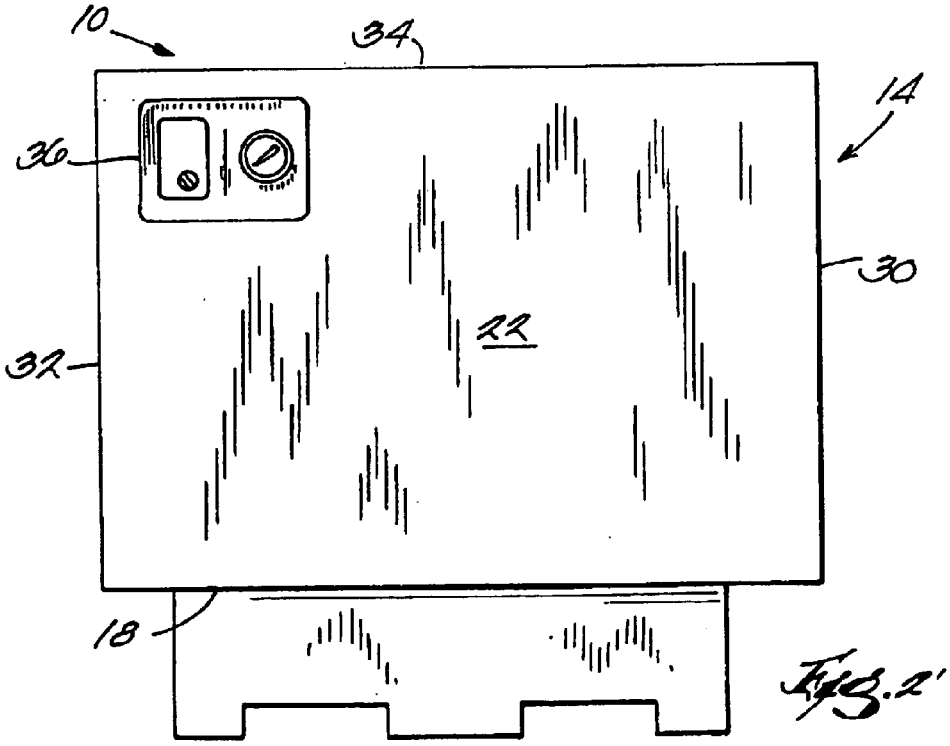
FIG. 2 is a side elevation view of the air compressor unit of FIG. 1.

As shown in FIGS. 1 and 2, the air compressor unit 10 includes an enclosure 14 that surrounds the unit 10 to reduce the amount of noise that emanates from the unit 10. The enclosure 14 defines an interior volume within the enclosure 14. In the illustrated embodiment, the enclosure 14 has a substantially rectangular box shape, and has a base 18, front wall 22, rear wall 26, a first side wall 30, a second side wall 32, and a top wall 34. The enclosure 14 is preferably made from metal, or a similar rigid, durable material, such as plastic. In FIGS. 1 and 2, a controller 36 is disposed on the front wall 22, and includes components for controlling the unit 10.

Figure 3:
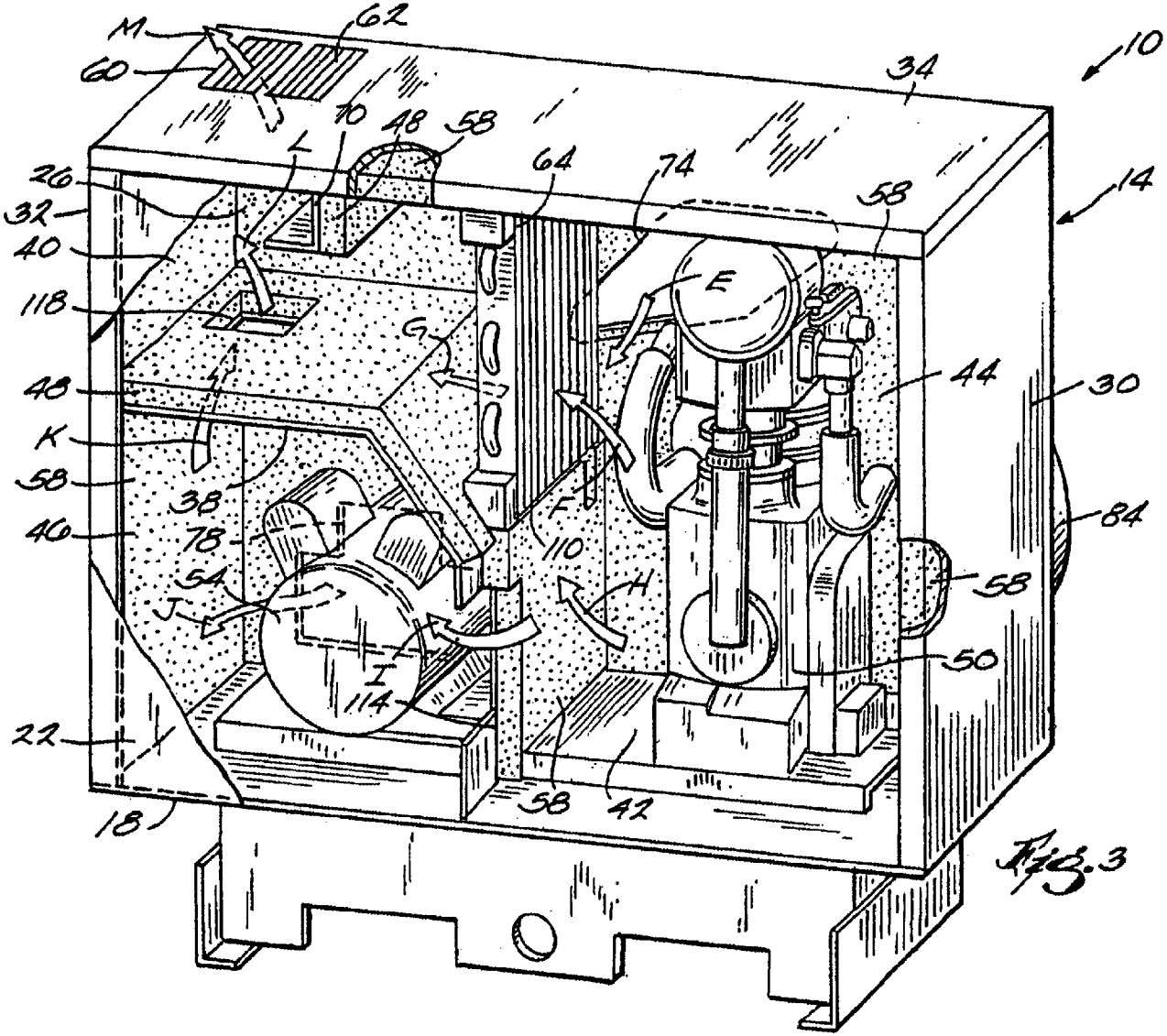
FIG. 3 is a perspective cut-away view of the air compressor unit of FIG. 1.

FIG. 3 is a cut-away view showing the internal components of the unit 10. The interior volume of the enclosure 14 is separated into multiple compartments. A partition 38 at least partially separates the interior volume within the enclosure 14 into two compartments: a discharge compartment 40 and a component compartment 42. The component compartment 42 may be further divided into a first compartment 44 and a second compartment 46. In the illustrated embodiment, the first compartment 44 and the second compartment 46 together make up the component compartment 42. As illustrated in FIG. 3, the first compartment 44 is disposed near the right side of the enclosure 14, and the second compartment 46 is disposed near the lower left side of the enclosure 14. In FIG. 3, a compressor 50 is disposed in the first compartment 44, and a motor 54 is disposed in the second compartment 46. The partition 38 may at least partially separate the first compartment 44 from the second compartment 46.

In the illustrated embodiment, the partition 38 extends between the front wall 22 and the rear wall 26, and the partition 38 intersects the second side wall 32 and the base 18. The partition 38 may comprise one continuous section, or multiple interconnected sections. The partition 38 may be made from sheet metal, plastic, or a similar rigid, durable material, and may also include a layer of acoustic foam 58 that absorbs sound waves and reduces the amount of noise that travels through the enclosure 14. In the illustrated embodiment, the foam 58 is disposed on the side of the partition 38 facing away from the second compartment 46, and toward the discharge compartment 40 and first compartment 44. Additionally, the base 18 and walls 22, 26, 30, 32, 34 of the enclosure 14 may include a layer of acoustic foam 58 to impede the emanation of sound from the enclosure 14.

The top wall 34 has a discharge aperture 60 disposed near the second side wall 32. The discharge aperture 60 is in fluid flow communication with the discharge compartment 40, and allows air to exit the enclosure 14. The discharge compartment 40 is separated from the component compartment 42. Additionally, the discharge compartment 40 substantially separates the discharge aperture 60 from the noise sources. The discharge aperture 60 may have multiple louvers 62 that permit the cooling air flow to exit the enclosure 14, and also reduce the amount of noise that emanates from the unit 10.

In the illustrated embodiment, an aftercooler 64 is disposed within the enclosure 14. In FIG. 3, the aftercooler 64 extends between the front wall 22, the rear wall 26, the partition 38, and the top wall 34. The aftercooler 64 is a heat exchanger that cools the compressed air from the compressor 50. Cooling ambient air flow over the fins of the aftercooler 64 is required to adequately cool the compressed air within the aftercooler 64. In the illustrated embodiment, the aftercooler 64 is disposed between the compressor 50 and the discharge aperture 60, and at least partially separates the discharge compartment 40 from the component compartment 42. More particularly, the aftercooler 64 separates the discharge compartment 40 from the first compartment 44.

As shown in FIG. 3, the aftercooler 64 at least partially defines the discharge compartment 40. In the illustrated embodiment, the discharge compartment 40 is defined by the partition 38, the second side wall 32, the rear wall 26, the front wall 22, the top wall 34, and the aftercooler 64. As mentioned above, the discharge aperture 60 is in fluid flow communication with the discharge compartment 40. The discharge compartment 40 insulates the discharge aperture 60 from the primary noise sources of the unit 10. It is not necessary for the aftercooler 64 to form a portion of the border between the discharge compartment 40 and the first compartment 44. The aftercooler 64 could be located elsewhere, however the aftercooler 64 must be in a position to have adequate cooling ambient air flow over the aftercooler 64.

Alternatively, the aftercooler 64 could be located elsewhere within the enclosure 14, or possibly outside of the enclosure 14. The partition 38 could extend upwardly to intersect the top wall 34 and substantially separate the discharge compartment 40 from the first compartment 44. In the illustrated embodiment, the discharge compartment 40 is not completely sealed from the first compartment 44 because cooling air must flow from the first compartment 44 to the discharge compartment 40, and exit through the discharge aperture 60.

Noise generally emanates in a direct, or "line of sight", path from a noise source. The illustrated invention is intended to reduce the amount of noise emanating from the enclosure 14 by breaking up the "line of sight" transference of noise and disrupting the direct path in which sound travels from the noise source toward an outlet. The discharge aperture 60 is an outlet through which noise may emanate from the enclosure 14. In the illustrated unit 10, the two main noise sources are the compressor 50 and the motor 54. A fan or blower 66 (described below) may also be a noise source. The compressor 50 generally creates more noise than the motor 54, and the illustrated embodiment has a barrier comprised of the partition 38, aftercooler 64, and a baffle 70 disposed between the compressor 50 and the discharge aperture 60.

In FIG. 3, the compressor 50 is disposed in the first compartment 44. In the illustrated embodiment, the compressor 50 is a reciprocating compressor or piston compressor. Alternatively, the compressor 50 could be a rotary compressor or other type of conventional air compressor. A reciprocating compressor generally requires more air flow to cool the compressor than a rotary compressor requires. Therefore, the flow of adequate cooling air through the enclosure 14 is a significant concern when the compressor 50 is a reciprocating compressor. The compressor 50 is usually the component of the unit 10 that creates the most noise, and is contained within the component compartment 42 and separated from the discharge compartment 40 and discharge aperture 60.

The discharge compartment 40 generally creates a barrier between the noise sources and the discharge aperture 60. The barrier between the compressor 50 and the discharge aperture 60 may be formed by the partition 38, the aftercooler 64, walls 22, 26, 30, 32, 34, a baffle 70, or other similar structures. These barriers obstruct the path of the noise, and force the noise and air to take a serpentine path from the compressor 50 toward the discharge aperture 60.

As shown in FIG. 3, the baffle 70 is disposed near the discharge aperture 60, between the discharge aperture 60 and the compressor 50. The baffle 70 extends downwardly from the top wall 34 to break up the "line of sight" direct path for noise emanating from the compressor 50 to the discharge aperture 60. The baffle 70 is a solid member that may be made of metal, plastic, or a similar rigid material, and may include a layer of acoustic foam 58. The baffle 70 does not extend completely from the top wall 34 to the partition 38, because air must flow past the baffle 70 to reach the discharge aperture 60. The baffle 70 also helps create an even air distribution over the aftercooler 64 when the aftercooler 64 is located near the baffle 70.

In the illustrated embodiment, the baffle 70 does not extend completely from the rear wall 26 to the front wall 22. The controller 36 (FIG. 1) is mounted on the front wall 22, and extends rearwardly from the front wall 22 into the discharge compartment 40. The controller 36 may prevent the baffle 70 from fully extending from the rear wall 26 to the front wall 22.

Additional baffles 70 may also be included within the enclosure 14 to further impede the emanation of noise. The location of additional baffles 70 could depend upon the location of other features, such as the aftercooler 64, partition 38, or discharge aperture 60. As mentioned above, the aftercooler 64 could be placed at a different location, and the partition 38 or additional baffles 70 could be used to define the discharge compartment 40.

Figure 4:
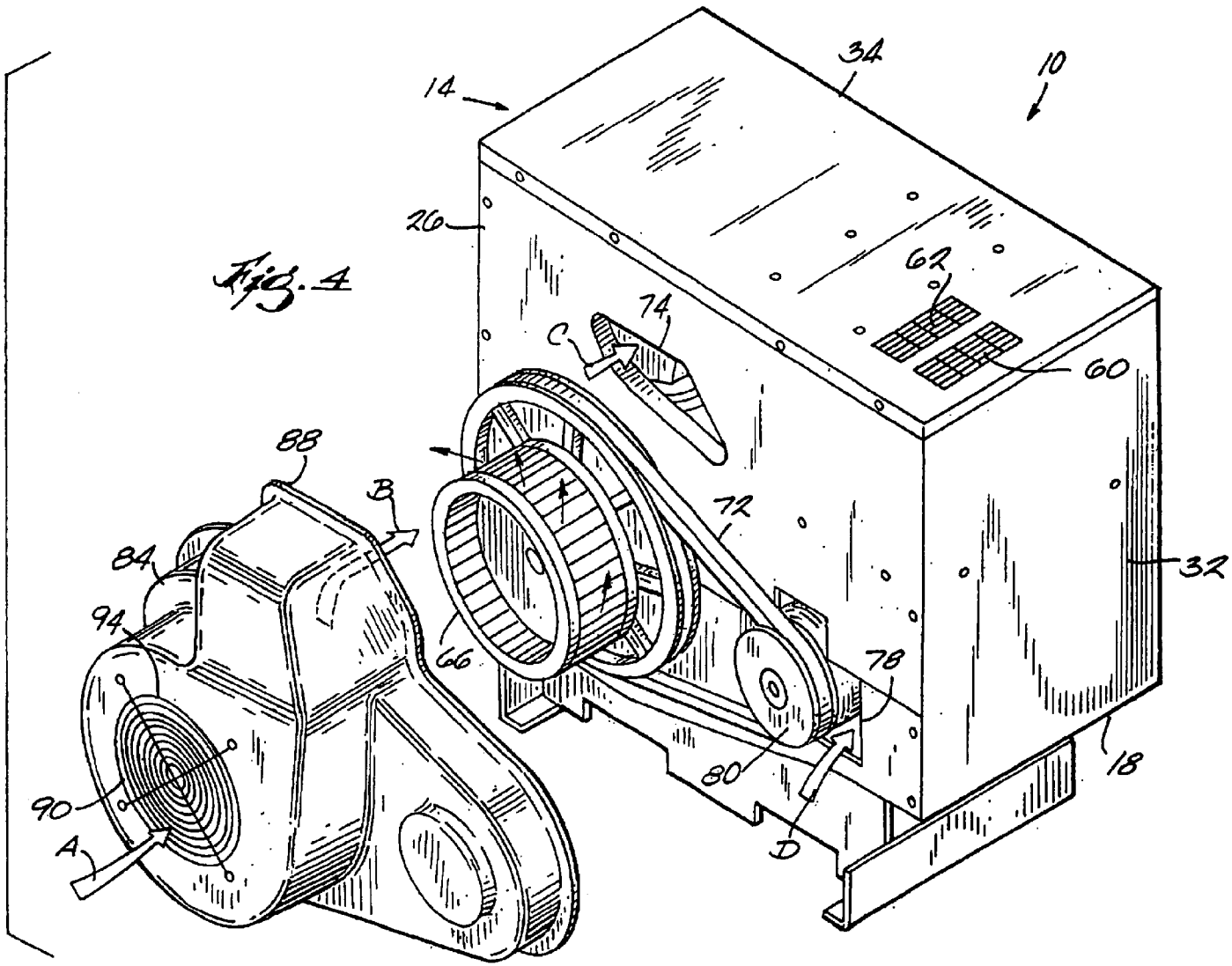
FIG. 4 is a partially exploded rear perspective view of the air compressor unit of FIG. 1.

In the illustrated embodiment, the compressor 50 is powered by the motor 54. The motor 54 may be a conventional electric motor, and may be disposed in the second compartment 46. The compressor 50 and the motor 54 are both interconnected or mounted to the base 18, and power may be transferred from the motor 54 to the compressor 50 through a belt drive 72 (FIG. 4). The motor 54 generally creates less noise than the compressor 50. The motor 54 could be mounted at a different location than shown in the illustrated embodiment, and could possibly be disposed outside the enclosure 14 depending on the amount of noise emitted by the motor 54.

Noise reduction must be balanced with adequate cooling air flow, because the unit 10 must still have sufficient air flow through the enclosure 14 to cool the compressor 50, motor 54 and aftercooler 64. The enclosure 14 has at least one cooling air inlet to allow sufficient cooling ambient air to enter the enclosure 14. As illustrated in FIG. 3, the enclosure 14 has two inlets in the rear wall 26: a primary inlet 74 and a secondary inlet 78. Both air inlets 74, 78 are in fluid flow communication with the component compartment 42 to provide a sufficient flow of cooling air into the enclosure 14. In the illustrated embodiment, the primary inlet 74 is in fluid flow communication with the first compartment 44, and the secondary inlet 78 is in fluid flow communication with the second compartment 46. More air generally enters the enclosure 14 through the primary inlet 74 than through the secondary inlet 78. As described below, the air inlets 74, 78 may also permit sound to emanate from the enclosure 14.

FIG. 4 illustrates a partially exploded rear view of the enclosure 14. The motor 54 has a drive wheel 80 that extends through the secondary inlet 78 in the rear wall 26. The motor 54 rotates the drive wheel 80 and powers a belt drive 72. The belt drive 72 rotates a blower 66 that forces air into the enclosure 14 through the primary inlet 74 and the secondary inlet 78. The blower 66 is coupled to the enclosure 14, and is also interconnected to a compressor shaft (not shown). The belt drive 72 rotates the compressor shaft (not shown) which powers the compressor 50 (FIG. 3).

As illustrated in FIG. 4, a shroud 84 is coupled to the rear wall 26, and covers the belt drive 72, the blower 66, and the drive wheel 80. The shroud 84 may be made from plastic, metal, or a similar relatively rigid material. The shroud 84 may be coupled to the enclosure 14 with conventional fasteners, such as screws or bolts. The blower 66 is a source of noise, and the shroud 84 at least partially surrounds the blower 66 to prevent noise from emanating from the blower 66 to the atmosphere.

The shroud 84 may define an intake compartment 88 that houses the blower 66. In the illustrated embodiment, the intake compartment 88 is in fluid communication with the primary inlet 74, the secondary inlet 78, and an air intake 90. The intake compartment 88 breaks up the direct "line of sight" path for noise that may emanate through the inlets 74, 78 toward the air intake 90.

In the illustrated embodiment, the blower 66 is preferably a rotary blower. Alternatively, the blower 66 could be a propeller-type fan. It is preferable to have a high static pressure within the shroud 84 to force the cooling air through the inlets 74, 78, and through the indirect air flow paths and multiple compartments in the enclosure 14. A rotary blower 66 generally produces a higher static pressure than a propeller fan.

The blower 66 draws air into the shroud 84 through the air intake 90. The high static pressure of the blower 66 forces the cooling air through the enclosure 14 to provide adequate cooling air for the components of the unit 10. A screen 94 is disposed in the air intake 90, and allows air to enter the shroud 84. The screen 94 prevents large objects from entering the shroud 84 that may damage the blower 66 or the unit 10.

In FIGS. 3 and 4, the arrows, identified by the letters A–M, represent the direction of the cooling air flow path through the shroud 84 and the enclosure 14. Air flow A is drawn into the shroud through the air intake 90, and the blower 66 and shroud 84 direct the air flow B toward the primary inlet 74 and the secondary inlet 78. Air flow C enters the enclosure 14 through the primary inlet 74, and air flow D enter the enclosure 14 through the secondary inlet 78.

The rotary blower 66 generally draws the air into the shroud 84 through the air intake 90, and then redirects the air flow in a radial direction from the blower 66, thus creating a circular air flow pattern within the shroud 84. In the illustrated embodiment, the shroud 84 is shaped with a rounded surface to guide the circular, indirect air flow toward the inlets 74, 78. The circular air flow and high static pressure created by the blower 66 allows the air to flow in an indirect path, which impedes noise from emanating from the shroud 84.

Noise exiting the enclosure 14 through the inlets 74, 78 can not emanate in a direct "line of sight" path from the inlets 74, 78 to the air intake 90, and will be at least partially blocked by the shroud 84. Therefore, the rotary blower 66 and shroud 84 create an indirect air flow and reduce the amount of noise emanating from the enclosure 14. A propeller fan generally blows air in a direct path. If a propeller fan were used, it would permit additional noise to leave the enclosure 14 through the direct path from the inlets 74, 78, past the propeller fan, and out the air intake 90.

In FIG. 4, air flow C enters the enclosure 14 through the primary inlet 74, and continues through the primary inlet 74 in FIG. 3 as air flow E. In FIG. 4, air flow D enters the enclosure 14 through the secondary inlet 78, and continues through the secondary inlet 78 in FIG. 3 as air flow J. The high static pressure of the air flow forces the air to flow through the multiple compartments and exit the enclosure 14 through the discharge aperture 60.

As mentioned above, the enclosure 14 illustrated in FIG. 3 is separated into multiple compartments 40, 44, 46, and the various components of the unit 10 are disposed within these separate compartments 40, 44, 46. The multiple compartments 40, 44, 46 isolate the noise sources and reduce the amount of noise that emanates from the enclosure 14. Because of the multiple compartment arrangement of the enclosure 14, cooling air is forced through the multiple compartments 40, 44, 46 to adequately cool the components of the unit 10. The multiple compartment arrangement causes the air flow to change direction and flow in an indirect, serpentine path as it passes through the enclosure 14.

The air flow enters the enclosure 14 and is divided to pass through the various compartments 40, 44, 46. The air flow then collects and converges in the discharge compartment 40 before exiting the enclosure through the discharge aperture 60. The compartments and the air flow may be arranged in a series path or a parallel path. In the illustrated embodiment, the air flow takes a parallel path through the unit 10. The unit 10 as a whole has one inlet for the air flow, the air intake 90 (FIG. 4), and one outlet for the air flow, the discharge aperture 60. After entering the air intake 90 (FIG. 4), the air flow splits into multiple air flow paths, and then converges to a single air flow path as the air exits through the discharge aperture 60.

As shown in FIG. 3, the enclosure 14 has a first passage 110, a second passage 114 and a third passage 118 that interconnect the compartments 40, 44, 46 and facilitate air flow through the enclosure 14. The first passage 110 connects the first compartment 44 and the discharge compartment 40. In the illustrated embodiment, the aftercooler 64 is disposed in the first passage. The second passage 114 connects the first compartment 44 and the second compartment 46. The third passage 118 connects the second compartment 46 and the discharge compartment 40. The passages 110, 114, 118 permit fluid flow between the compartments 40, 44, 46.

Air flow E enters the first compartment 44 through the primary inlet 74 and may cool the compressor 50 before splitting into two air flows. A first air flow E, F, G, M may flow from the first compartment 44, through the first passage 110 and the aftercooler 64, into the discharge compartment 40, and past the baffle 70 before exiting through the discharge aperture 60. A second air flow E, I, K, L, M may flow from the first compartment 44, through the second passage 114, and into the second compartment 46 to cool the motor 54. The second air flow K, L, M then proceeds from the second compartment 46, through the second passage 118, into the discharge compartment, and out of the enclosure 14 through the discharge aperture 60. In the illustrated embodiment, the air flow enters the discharge compartment 40 through both the first passage 110 and the third passage 118. The first air flow E, F, G, M and the second air flow E, I, K, L, M both converge in the discharge compartment 40 before the combined air flow M exits through the discharge aperture 60.

The second passage 114 is sized to balance the amount of heat within the enclosure 14 between the first compartment 44 and the second compartment 46. The second passage 114 is sized to allow a sufficient amount of cooling air to flow through the second passage 114 to maintain the first compartment 44 and the second compartment 46 at similar temperatures. Additionally, the size of the second passage 114 effects the total amount of air that passes through the first passage 110 and the aftercooler 64. The size of the second passage 114 may be used to "fine tune" the air flow through the enclosure 14. When the size of the second passage 114 is increased, more air flows through the second passage 114, and less air flows through the first passage 110 and the aftercooler 64. Similarly, when the size of the second passage 114 is decreased, less air flows through the second passage 114, and more air flows through the first passage 110 and the aftercooler 64.

Air flow J entering the second compartment 46 through the secondary inlet 78 also cools the motor 54. Air flow J then joins air flow I, K, L and flows through the third passage 118 into the discharge compartment 40, and merges with the combined air flow M which exits through the discharge aperture 60. In the illustrated embodiment, air flow I through the second passage 114 from the first compartment 44 cools the front of the motor 54, and air flow J entering the second compartment 46 through the secondary inlet 78 cools the back of the motor 54. The dual air flow, I and J, cooling the motor 54 from the second passage 114 and the secondary inlet 78 permits the size of the secondary inlet 78 to be relatively small, thereby reducing the amount of noise that emanates from the enclosure 14 through the motor inlet 78.

As shown in FIG. 3, the third passage 118 permits air to exit the second compartment 46, and flow into the discharge compartment 40. The size of the third passage 118 is preferably small enough to reduce the amount of noise radiating from the motor 54 toward the discharge aperture 60, and large enough to permit adequate cooling air to flow from the second compartment 46 to the discharge compartment 40. The balance between these two factors must be considered when selecting the size of the third passage 118. In the illustrated embodiment, the third passage 118 is located near the second side wall 32, and is slightly offset from the motor 54 to reduce the amount of direct "line of sight" noise that exits the enclosure 14 through the discharge aperture 60.

What is claimed is:

1. An air compressor unit comprising:

multiple compartments within the air compressor unit including at least first and second compartments, an air compressor disposed in the first compartment and a motor, configured to drive the air compressor, disposed within the second compartment;

a rotary blower that draws air into the unit and generates an air flow through the unit;

an air intake port entering the unit;

a discharge aperture exiting the unit;

wherein the multiple compartments are configured such that a single initial air flow enters the unit through the intake port, the multiple compartments divide the initial air flow into at least first and second distinct intermediate air flows with the first intermediate air flow flowing through the first compartment and the second intermediate air flow flowing through the second compartment, the distinct intermediate air flows converge to a single final air flow that exits the unit through the discharge aperture.

2. The unit of claim 1, wherein the multiple compartments include an intake compartment, the first compartment, the second compartment, and a discharge compartment.

3. The unit of claim 2, wherein the air intake port is in fluid flow communication with the intake compartment, and the initial air flow enters the intake compartment through the air intake port.

4. The unit of claim 2, wherein the discharge aperture is in fluid flow communication with the discharge compartment, and the final air flow exits the discharge compartment through the discharge aperture.

5. The unit of claim 1, wherein the compressor is a reciprocating compressor.

6. An air compressor unit comprising:

multiple compartments within the air compressor unit including at least first and second compartments, an air compressor disposed in the first compartment and a motor disposed within the second compartment;

a rotary blower the draws air into the unit and generates an air flow through the unit;

an air intake port entering the unit;

a discharge aperture exiting the unit;

wherein the multiple compartments are configured such that a single initial air flow enters the unit through the intake port, the multiple compartments divide the initial air flow into at least first and second distinct intermediate air flows with the first intermediate air flow flowing through the first compartment and the second intermediate air flow flowing through the second compartment, the distinct intermediate air flows converge to a single final air flow that exits the unit through the discharge aperture, and wherein the multiple compartments include an intake compartment, the first compartment, the second compartment, and a discharge compartment and the first intermediate air flow passes through the first compartment and the discharge compartment;

the second intermediate air flow passes through the first compartment, the second compartment, and the discharge compartment; and the first intermediate air flow and the second intermediate air flow converge into the final air flow in the discharge compartment.

7. An air compressor unit comprising:

multiple compartments within the air compressor unit including at least first and second compartments and a discharge compartment, an air compressor and a motor disposed within the air compressor unit;

a rotary blower that draws air into the unit and generates an air flow through the unit;

an air intake port entering the unit; and a discharge aperture exiting the unit;

wherein the multiple compartments are configured such that a single initial air flow enters the unit through the intake port, the multiple compartments divide the initial air flow into at least first and second distinct intermediate air flows with the first intermediate air flow flowing through the first compartment and the second intermediate air flow flowing through the second compartment, the distinct intermediate air flows converge to a single final air flow in the discharge compartment and exits the unit through the discharge aperture and wherein an aftercooler is disposed between the first compartment and the discharge compartment and defines a fluid passage from the first compartment to the discharge compartment.

8. An air compressor unit comprising:

multiple compartments within the air compressor unit including at least first and second compartments, an air compressor disposed in the first compartment and a motor disposed within the second compartment;

a rotary blower that draws air into the unit and generates an air flow through the unit;

an air intake port entering the unit;

a discharge aperture exiting the unit;

wherein the multiple compartments are configured such that a single initial air flow enters the unit through the intake port, the multiple compartments divide the initial air flow into at least first and second distinct intermediate air flows with the first intermediate air flow flowing through the first compartment and the second intermediate air flow flowing through the second compartment, the distinct intermediate air flows converge to a single final air flow that exits the unit through the discharge aperture, and wherein the multiple compartments include an intake compartment, the first compartment, the second compartment, and a discharge compartment and the rotary blower is disposed in the intake compartment.

9. An air compressor unit comprising:

multiple compartments within the air compressor unit including at least first and second compartments and a discharge compartment, an air compressor a motor disposed within the air compressor unit;

a rotary blower that draws air into the unit and generates an air flow through the unit;

an air intake port entering the unit; and a discharge aperture exiting the unit;

wherein the multiple compartments are configured such that a single initial air flow enters the unit through the intake port, the multiple compartments divide the initial air flow into at least first and second distinct intermediate air flows with the first intermediate air flow flowing through the first compartment and the second intermediate air flow flowing through the second compartment, the distinct intermediate air flows converge to a single final air flow in the discharge compartment and exits the unit through the discharge aperture and wherein a partition at least partially separates the first compartment from the second compartment, and the partition at least partially separates the second compartment from the discharge compartment.

10. The unit of claim 9, wherein the partition includes a layer of noise absorbing foam.

11. An air compressor unit comprising:

an intake compartment having an air intake permitting air to enter the air compressor unit;

a blower disposed within the intake compartment drawing air into the intake compartment through the air intake, and generating an air flow through the unit;

a primary inlet permitting fluid flow between the intake compartment and a first compartment;

a secondary inlet permitting fluid flow between the intake compartment and a second compartment;

a first passage permitting fluid flow between the first compartment and a discharge compartment;

a second passage permitting fluid flow between the first compartment and a second compartment;

a third passage permitting fluid flow between the second compartment and the discharge compartment; and a discharge aperture in fluid flow communication with the discharge aperture permitting air to exit the unit.

12. The unit of claim 12, further comprising a compressor disposed within the first compartment.

13. The unit of claim 12, wherein the compressor is a reciprocating compressor.

14. The unit of claim 11, further comprising a motor disposed within the second compartment.

15. The unit of claim 11, further comprising an aftercooler disposed near the first passage.

16. The unit of claim 11, wherein a partition at least partially separates the first compartment from the second compartment, and the partition at least partially separates the second compartment from the discharge compartment.

17. The unit of claim 16, wherein the partition includes a layer of noise absorbing foam.

* * * * *

UNITED STATES PATENT AND TRADEMARK OFFICE

CERTIFICATE OF CORRECTION

PATENT NO. : 6,790,012 B2
DATED : September 14, 2004
INVENTOR(S) : Stephen J. Sharp et al.

It is certified that error appears in the above-identified patent and that said Letters Patent is hereby corrected as shown below:

Column 10,
Line 25, after "air compressor", first occurrence, insert -- and --.

Column 11,
Line 1, delete "claim 12", and replace with -- claim 11 --.

Signed and Sealed this

Seventh Day of December, 2004

JON W. DUDAS
*Director of the United States Patent and Trademark Office*